US012529549B2

(12) United States Patent
Gelfert et al.

(10) Patent No.: US 12,529,549 B2
(45) Date of Patent: Jan. 20, 2026

(54) TOOL AND METHOD FOR PRODUCING A PROJECTILE AND PROJECTILE

(71) Applicant: RWS GmbH, Fürth (DE)

(72) Inventors: Stephan Gelfert, Wilhermsdorf (DE); Donald Meyer, Groley (CH)

(73) Assignee: RWS GmbH, Fürth (DE)

( * ) Notice: Subject to any disclaimer, the term of this patent is extended or adjusted under 35 U.S.C. 154(b) by 52 days.

(21) Appl. No.: 18/322,830

(22) Filed: May 24, 2023

(65) Prior Publication Data

US 2024/0200918 A1 Jun. 20, 2024

(30) Foreign Application Priority Data

May 24, 2022 (DE) ..... 102022113108

(51) Int. Cl.

| | |
|---|---|
| ***F42B 12/34*** | (2006.01) |
| ***B21K 21/06*** | (2006.01) |
| ***F42B 8/14*** | (2006.01) |
| ***F42B 12/22*** | (2006.01) |
| ***F42B 12/74*** | (2006.01) |
| ***F42B 12/78*** | (2006.01) |
| ***F42B 30/02*** | (2006.01) |
| ***F42B 33/00*** | (2006.01) |
| *F42B 12/38* | (2006.01) |

(52) U.S. Cl.

CPC ..... *F42B 12/34* (2013.01); *B21K 21/06* (2013.01); *F42B 8/14* (2013.01); *F42B 12/74* (2013.01); *F42B 12/78* (2013.01); *F42B 33/00* (2013.01); *F42B 12/22* (2013.01); *F42B 12/38* (2013.01); *F42B 30/02* (2013.01)

(58) Field of Classification Search

CPC .. F42B 8/14; F42B 12/22; F42B 12/34; F42B 12/367; F42B 12/38; F42B 12/74; F42B 12/76; F42B 12/78; F42B 30/02; F42B 33/00; B21K 21/06

USPC ..... 102/501, 503, 506, 507, 508, 509, 514

See application file for complete search history.

(56) References Cited

U.S. PATENT DOCUMENTS

| | | | | |
|---|---|---|---|---|
| 2,045,964 A | | 6/1936 | Rinkel | |
| 5,131,123 A | | 7/1992 | Brooks | |
| 5,259,320 A | * | 11/1993 | Brooks | B21K 21/06 102/501 |

(Continued)

FOREIGN PATENT DOCUMENTS

| | | | | |
|---|---|---|---|---|
| DE | 4435859 A1 | * | 4/1996 | F42B 12/34 |
| DE | 102016015790 A1 | | 3/2018 | |

(Continued)

OTHER PUBLICATIONS

Machine translation of DE 4435859 A1 (Year: 1996).*
Oct. 11, 2023 (EP) Search Report—App. 23173741.
Jan. 30, 2023 (DE) Office Action—App. DE 102022113108.4.

*Primary Examiner* — James S Bergin
(74) *Attorney, Agent, or Firm* — Banner & Witcoff, Ltd.

(57) ABSTRACT

A projectile may be formed having a caliber in the range from 4.6 mm to 20 mm for ammunition. The projectile may be a deformation bullet, a partial fragmentation bullet, a partial or full jacket bullet, a hard-core bullet or tracer bullet. The projectile may be formed by cold forming, in particular extrusion, from an intermediate with a tube section of substantially constant wall thickness, which constitutes at least 50% of the longitudinal extension of the intermediate.

15 Claims, 9 Drawing Sheets

(56) References Cited

U.S. PATENT DOCUMENTS

| | | | | |
|---|---|---|---|---|
| 5,400,716 | A | 3/1995 | Mayer | |
| 5,943,749 | A | 8/1999 | Swank | |
| 6,070,532 | A * | 6/2000 | Halverson | F42B 14/02 102/501 |
| 6,776,101 | B1 * | 8/2004 | Pickard | F42B 12/34 102/509 |
| 8,186,277 | B1 * | 5/2012 | King | F42B 12/34 102/509 |
| 8,511,233 | B2 * | 8/2013 | Nilsson | F42B 12/34 102/521 |
| 11,561,074 | B2 * | 1/2023 | Spanner | F42B 12/34 |
| 11,879,709 | B2 * | 1/2024 | Spanner | F42B 12/74 |
| 12,305,965 | B2 * | 5/2025 | Spanner | F42B 12/34 |
| 2008/0216700 | A1 | 9/2008 | Martini Filho | |
| 2021/0270585 | A1 | 9/2021 | Wagner | |
| 2022/0381542 | A1 | 12/2022 | Grünig et al. | |
| 2024/0142206 | A1 * | 5/2024 | Muster | F42B 12/74 |
| 2024/0230294 | A9 * | 7/2024 | Meyer | F42B 8/12 |
| 2024/0302145 | A1 * | 9/2024 | Spanner | F42B 12/34 |
| 2025/0116494 | A1 * | 4/2025 | Muster | F42B 33/00 |

FOREIGN PATENT DOCUMENTS

| | | | |
|---|---|---|---|
| DE | 102017011359 | A1 | 6/2019 |
| DE | 102019116125 | A1 | 12/2020 |
| DE | 102019135875 | A1 | 7/2021 |
| DE | 102020105266 | A1 | 9/2021 |
| DE | 102021104757 | A1 | 9/2022 |
| WO | 9005891 | A1 | 5/1990 |

* cited by examiner

TOOL AND METHOD FOR PRODUCING A PROJECTILE AND PROJECTILE

CROSS REFERENCE TO RELATED APPLICATIONS

This patent application claims priority to German Patent Application No. 102022113108.4, filed May 24, 2022, which is incorporated herein by reference in its entirety.

BACKGROUND

Field

The present disclosure relates to a tool and a method for producing or manufacturing a projectile with a caliber in the range of 4.6 mm to 20 mm, in particular a deformation bullet, partial fragmentation bullet, partial or full jacket bullet, hard-core bullet or a tracer bullet. Furthermore, the present disclosure provides a projectile with a caliber in the range of 4.6 mm to 20 mm, in particular a deformation bullet, partial fragmentation bullet, partial or full jacket bullet, hard-core bullet or a tracer bullet.

Related Art

German patent application DE 10 2017 011 359 A1 describes manufacturing a projectile by deep-drawing with the help of a so-called intermediate or intermediate product, whereby the deep-drawing is applied using a punch-die arrangement. According to DE 10 2017 011 359 A1, the wall to be formed into the ogive in the subsequent forming process of the intermediate has a plurality of slots extending in the axial direction of the intermediate, which form a corresponding number of tines or wall sections separated in the circumferential direction by the slots. In the intermediate and also in the projectile made therefrom, the cavity on the ogive side is at least partially closed in the circumferential direction by pressing the structurally separated tines together, only when the slotted wall is formed into an ogive section. To manufacture the intermediate, a mandrel-shaped punch with a blade corresponding to a slotted screwdriver is used, which is pressed into a blank of solid material inserted in a cylindrical die.

The intermediate and the projectile according to DE 10 2017 011 359 A1 have proven themselves in principle, as it is possible to achieve an extremely simple but uniform deformation of the blank, so that a precise projectile can be provided which is optimized with regard to the deformation property in wound ballistics, in particular for a specific range of use. The intermediate/projectile cold-formed in this way has proven to be advantageous, particularly with regard to the desired partial fragmentation- or deformation behavior in wound ballistics, in particular for an often-limited velocity range. However, it turned out that the intermediates and projectiles have limited suitability as deformation bullets for other bullet types. It has also been found that the mandrel tools are very heavily loaded and could be improved, in particular for mass production.

The heavy and/or unfavorable loading of the mandrel tools occurs in particular due to the inaccurate centering of the tools and the increased forming work. The inaccurate centering can cause not only compressive stresses, but also bending moments in the mandrel, which can ultimately lead to tensile stresses. Since in particular mandrel tools are made of carbide or hardened steel, even small tensile stresses can lead to a violent fracture of the mandrel, since these materials are very susceptible to violent fracture under tensile stresses.

For manufacturing reasons, in particular due to the intermediate-punch combination, the intermediate and the projectile according to DE 10 2017 011 359 A1 are limited by design with regard to the length-to-diameter ratio of the cavity. In this context, the cavity on the ogive side may only be approximately as deep as the diameter of the cavity. This means that a deep cavity results in a thin-walled ogive section. A thick-walled ogive section can therefore only have a minimum cavity depth. Because of these constructive constraints, the projectile is configured to be suitable for only a limited range of velocities and to deform as desired only in a limited velocity band. It may even be that a given velocity leads to an uneven deformation of the projectile in wound ballistics and this, in extreme cases, will lead to an unwanted and arbitrary disintegration of the projectile, wherein, in the end, the projectile is no longer regarded as a mass-stable deformation bullet.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

FIG. 1 a sectional view of a tubular intermediate for manufacturing a projectile according to an aspect of the disclosure.

FIG. 2 a sectional view of a countersunk tubular intermediate for manufacturing a projectile according to an aspect of the disclosure.

FIG. 3 a sectional view of a pressed part in a die according to an aspect of the disclosure.

FIG. 4 a sectional view of a projectile as deformation bullet according to an aspect of the disclosure.

FIGS. 5-8 a schematic stage plan for manufacturing of a projectile as a full jacket bullet starting from a tubular intermediate according to an aspect of the disclosure.

FIGS. 9-12 a schematic stage plan for manufacturing of a projectile as a partial jacket bullet starting from a tubular intermediate according to an aspect of the disclosure.

FIGS. 13-16 a schematic stage plan for manufacturing of a projectile as a partial jacket bullet starting from a tubular intermediate according to an aspect of the disclosure.

FIG. 17 a schematic view of a projectile in a deformed state after impacting a target with segment-flag propagation parallel to the longitudinal direction of the bullet according to an aspect of the disclosure.

FIG. 18 a schematic view of a projectile in a deformed state after impacting a target with segment-flag propagation perpendicular to the longitudinal direction of the bullet according to an aspect of the disclosure.

FIG. 19 a schematic view of a tool with a polygonal cross-section and a concave, conically-shaped and convex forming section according to an aspect of the disclosure.

FIG. 20 a side view of the tool according to FIG. 19.

FIG. 21 a schematic view of a tool with a polygonal cross-section and a convex forming section according to an aspect of the disclosure.

FIG. 22 a side view of a tool with a round cross-section and a convex forming section according to an aspect of the disclosure.

FIG. 23 a perspective view of a tool with a hexagonal cross-section and a convex forming section according to an aspect of the disclosure.

FIGS. 24-33 perspective views of tubular intermediates with a point-symmetric inner cross-section according to aspects of the disclosure.

FIG. 34*a, b* Hardness profile of a projectile starting from a conventional wire-intermediate.

FIG. 35*a,b* Hardness profile of a projectile according to an aspect of the disclosure starting from a tube-intermediate with substantially constant wall thickness.

The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, and components, have not been described in detail to avoid unnecessarily obscuring embodiments of the disclosure.

An object of the present disclosure is to improve the disadvantages from the known prior art, in particular to provide a method and a tool for manufacturing a projectile as well as to provide such a projectile which is easier to manufacture.

In accordance with one aspect of the present disclosure, a projectile with a caliber in the range of 4.6 mm to 20 mm for ammunition is provided. The projectile may be a deformation bullet, a partial fragmentation bullet, a partial or full jacket bullet, a hard-core bullet, or a tracer bullet. The caliber is generally referred to as a measure of the outer diameter of projectiles or bullets and the inner diameter of a firearm barrel.

In the case of partial jacket bullets or partial fragmentation bullets, the core is not enclosed by jacket material on the bullet front side and is exposed. On impact with a target, the bullet front deforms due to the high pressure on impact and when penetrating the target. For example, the projectile may deform mushroom-shaped (mushrooming) or at least partially deform. As a result, the projectile can deliver its energy to the target medium much more effectively than a full jacket bullet, in which the jacket completely surrounds the core, but has a lower penetration performance. Such bullets are used in particular as hunting bullets, since these, for a shot in compliance with hunting principles, due to the effective energy release in the deer body, more reliably lead to a faster death of the deer being shot at, as compared to full jacket bullets. Partial fragmentation bullets are usually constructed in such a way that they fragment in a controlled manner except for a defined residual body. The suction effect of the residual body ensures that the fragments of the forward, disintegrated core part leave the target for the most part. Deformation bullets mushroom on impact with the target and remain mass-stable. As a rule, deformation bullets are designed to lose very little weight in the target. The effect is achieved primarily by the increase in cross-section of the projectile mushrooming uniformly and the constant weight.

Hard-core bullets are also known as penetrators or AP (Armor Piercing) bullets and are suitable for military use against armored targets, for example armored vehicles or protective vests. Hard-core bullets generally consist of a bullet jacket and a hard core inserted and/or embedded therein. The hard core is usually made of pure tungsten, tungsten carbide or hardened steel with a hardness greater than 550 HV. Tungsten and tungsten carbide are ideally suitable for penetrating ammunition for two reasons. Due to its high specific density, the tungsten or tungsten carbide core has a high kinetic energy, which is beneficial for penetration. Furthermore, the material is very hard, which means that the abrasive penetration process causes less damage to the core itself. Due to the core hardness, barrel wear is significantly increased. For this reason, the core of the projectile is often made of two parts. The front part consists of hard material and the rear part is made of softer material in order to embody the guide band of the projectile as protective on the barrel as possible. Another hard-core bullet construction principle is only two-part, where a hard-core is inserted into a thick-walled bullet shoe. The bullet shoe is made of soft material, which means that the protective barrel aspect only comes into play due to the bullet shoe.

Full bullets are also called solid bullets or monolithic bullets and are in particular made of one material. The bullet material is usually a soft, ductile material, preferably metal with a density of more than 5 g/cm3 Copper, tombac, brass or even pure lead can be used as solid bullet material. The intended use of solid projectiles is often found in special applications. For example, to hit targets behind glass panes. The nose of the projectile is flattened so that penetration of the glass pane does not lead to a change in the trajectory. In terms of production technology, solid bullets can be produced by solid forming or metal-removing. As a result, this structure is suitable for both small and large series.

Full jacket bullets usually have a jacket of deformable material, such as tombac, and a core arranged therein, which is manufactured separately from the bullet jacket. The bullet core is usually made of a softer material compared to the deformable material of the jacket. The core represents the main weight part of the projectile and is preferably made of a high-density material. In the case of the full jacket bullet, the jacket transfers the twist transmitted from the barrel to the core. Through the jacket, low-friction pressing through the barrel of the firearm can be ensured. The jacket also has the task of protecting the core, which is usually made of soft material, from the considerable forces generated during firing and projectile flight. Due to the full-frontal enclosure of the core with the jacket, the projectile is prevented from opening in the wound ballistic medium and a certain penetration capability on hard targets is ensured. The precision of the projectile, as well as the aerodynamics, are reduced with the full jacket bullet, compared to the partial jacket bullet, due to the frontal enclosure of the core. In the case of the partial jacketed bullet, the bullet core is not completely enclosed by a jacket material, but is exposed in the area of the bullet front, which leads to a desired deformation of the projectile after penetration into a target.

Tracer bullets are generally used exclusively for military purposes, as they are used to mark a target to be fired at or a direction to be fired at in the training area or war zone. The basic construction of a tracer bullet is the same as that of a full jacket bullet. In contrast to the full jacket bullet, a pyrotechnic charge is pressed into the rear. This set burns off during projectile flight, ignited by the hot propellant powder during firing. This burning serves for visualization of the projectile flight.

According to the first aspect of the present disclosure, the projectile is made, by means of cold forming, in particular extrusion, from an intermediate with a tube section of substantially constant wall thickness, which constitutes at least 50% of the longitudinal extension of the intermediate. The tube section may also constitute at least 60%, at least 70%, at least 80%, or at least 90% of the intermediate. For example, the intermediate is tubular shaped, in particular it consists of the intermediate. It was found that with such an intermediate with a tube section of significant length, it is possible to manufacture projectiles in a particularly precise manner using much more delicate tools purely by means of a cold forming process in a simple manner in terms of manufacturing technology, whereby a much lower working pressure can be used for the forming process, which improves the possibility of mass production. In addition, manufacturing tolerances are significantly improved. A particular advantage is that the initial outer diameter of the intermediate substantially corresponds to the caliber of the projectile to be produced, so that the metal material in the area of the outer diameter, in particular near the surface, is hardly hardened or deformed on the final projectile. This makes it possible to achieve a significantly more homogeneous metal structure, which has a positive effect on precision and/or a desired deformation in the case of a deformation bullet. The tube section also makes it possible for very delicate tools to penetrate very deeply into the intermediate, whereby very long service lives can be achieved in comparison with the solid body, since the tools suffer little damage due to the tube shape of the intermediate, in particular in contrast to a solid-material intermediate, as has been common practice to date.

The tube section is characterized in particular by the fact that the outer diameter is based on the permissible tensile dimension according to CIP, SAAMI or STANAG. The tensile dimension defines the intermediate outer diameter in the range from −0.15 mm to +0.05 mm.

According to another aspect of the present disclosure, which is combinable with the preceding aspects and exemplary embodiments, there is provided a projectile having a caliber in the range of 4.6 mm to 20 mm.

According to the further aspect of the present disclosure, the projectile is made, in particular by means of cold forming, in particular extrusion, from an intermediate with a tube section of substantially constant wall thickness, which constitutes at least 50% of the longitudinal extension of the intermediate. The tube section may also constitute at least 60%, at least 70%, at least 80% or at least 90% of the intermediate. For example, the intermediate is tubular shaped, in particular it consists of the intermediate.

Furthermore, according to another aspect of the present disclosure, an inner tube diameter of the intermediate is at most 50% of an outer tube diameter of the intermediate. The outer tube diameter serves as a reference for the inner tube diameter, since the outer tube diameter can be selected such that it already substantially corresponds to the caliber of the projectile to be produced, so that no further forming is required to obtain the desired dimensioning. As a result, working steps and thus forming steps that generate material stresses and cause hardness increases can be saved. According to this aspect of the disclosure, the thick wall thickness of the tube section is decisive, since the tube section is thus quite solid and resistant to the pressing forces that occur.

According to another aspect of the present disclosure, which is combinable with the preceding aspects and exemplary embodiments, there is provided a projectile with a caliber in the range of 4.6 mm to 20 mm.

According to the further aspect of the present disclosure, the projectile is made, in particular by cold forming, in particular extrusion, from an intermediate with a tube section of substantially constant wall thickness, which constitutes at least 50% of the longitudinal extension of the intermediate. The tube section may also constitute at least 60%, at least 70%, at least 80% or at least 90% of the intermediate. For example, the intermediate is tubular shaped, in particular it consists of the intermediate.

Further, according to another aspect of the present disclosure, an inner cross-section of the intermediate is point-symmetric, deviates from a circular shape, and is constant in the direction of the longitudinal extension. Thus, the inner cross-section of the intermediate may have any regular or irregular point-symmetric shape. The outer surface of the tube forms a cylindrical jacket surface. In this respect, the projectile inner geometry can be realized arbitrarily and flexibly in a simple manner, by corresponding formation of the tube inner cross-section, while otherwise retaining the projectile geometry, of the, in particular forming, manufacturing process, and the outer shape of the projectile. In particular, any internal geometries with different deformation properties can be manufactured in a simple manner.

A major advantage of the fact that the defined inner contour of the intermediate is retained even after forming, in particular cold forming, of the intermediate into a projectile is that further cost reduction potentials arise because it is possible to fall back on simple, for example purely conically shaped punches. The bullet cavity can be notched either with a segmented mandrel in a round-tube shaped intermediate or with a defined inner contour and a conically shaped punch.

Defined inner contours of the tubular shaped intermediate can, for example, be star-shaped, such as a non-convex regular polygon and have, for example, 10 to 100 edges of equal length. The projectile made from the star-shaped intermediate exhibits a fast response at low impact velocities, this due to the strong notch effect. Another defined inner contour is a polygon which comprises a closed path and in particular whose 5 to 50 edges are all of the same length. The previously described inner polygonal intermediate results in a projectile that deforms at increased impact velocities because the notch effect is weaker compared to the star-shaped intermediate. The notch effect is even lower in a projectile made from an intermediate with a defined inner contour in the form of an inner hexagon, also known as polylobular, consisting of 3 to 40 circular elements of equal length joined together. Further possibilities for controlling the response sensitivity as well as the susceptibility to disassembly are conceivable by means of tubular shaped intermediates with V-shaped notches. Here, the notch depth, the notch angle and/or the number of notches can be varied and adapted to the ballistic requirements. Since the intermediate according to the disclosure is an extrusion profile, delicate designs with 5 to 10 deep grooves or 5 to 20 ribs are also conceivable.

According to an exemplary further development of the projectile according to the disclosure, an outer diameter of the intermediate substantially corresponds to the caliber of the projectile. A significant advantage of this embodiment is that the outer dimensioning of the intermediate is already selected in such a way that the intermediate already has the outer dimension of the projectile to be manufactured. In this respect, the dimension-sensitive caliber of the projectile can be set in a simpler and more precise manner already during the production of the blank or intermediate without having to change the outer skin of the intermediate during the subsequent, in particular cold forming, production of the projectile shape. It has been found that it is much easier in terms of production technology to set the outer diameter in advance rather than during the much more complex projectile production or -forming.

According to another aspect of the present disclosure, which is combinable with the preceding aspects and exemplary embodiments, there is provided a projectile having a caliber in the range of 4.6 mm to 20 mm.

According to another aspect of the present disclosure, the projectile is made from an intermediate with a tube section of substantially constant wall thickness. The tube section may constitute at least 50%, in particular at least 60%, at least 70%, at least 80% or at least 90%, of the longitudinal extension of the intermediate. For example, the intermediate is tubular shaped, in particular it consists of the intermediate.

The tube section has a bullet jacket surrounding a central cavity, which bullet jacket has a bullet front tapering in particular in an ogive-like manner and an adjoining bullet rear with a solid rear portion which leads into a bullet bottom. In particular, the tube section, i.e. the bullet jacket with bullet rear, bullet front and bullet bottom, is made from one piece.

According to this aspect of the disclosure, an averaged hardness at the bullet bottom corresponds to at least 103%, in particular at least 105%, of that averaged hardness if the projectile were made from a solid intermediate, and/or an averaged hardness in the region of a jacket region of the bullet rear surrounding the cavity corresponds to at most 90%, in particular at most 85% or at most 80%, of that averaged hardness if the projectile were made from a solid intermediate. The averaged hardness is to be understood as an average value of the individual hardness values at the corresponding portions or sections and is intended to indicate the tendency, although it may be that the described ratios do not apply to individual values. For example, the hardness values may be determined using the hardness test according to Vickers (HV). The inventors have identified individual characteristics in the hardness profile to distinguish a projectile made in accordance with the disclosure from previously known projectiles, which reveal numerous advantages of the present disclosure. The softer area in the bullet rear has a positive effect on the barrel lifetime of the firearm and results in a longer tool lifetime. A soft intermediate region of the projectile is particularly relevant for long service lives of the tools. The softer the intermediate area of the eventual projectile remains due to the previous operations, the less forming work the tools had to perform during the operations. This results in a longer tool lifetime.

In an exemplary embodiment of the present disclosure, the hardness values are near-surface values. For example, they may be measured a few millimeters below the outer surface of the projectile.

In another exemplary embodiment of the present disclosure, the jacket region of the bullet rear surrounding the cavity comprises a guide band for engaging in a land-groove-profile of a firearm barrel, which guide band defines a maximum outer diameter of the projectile. A soft guide band enhances in particular the advantages described with regard to barrel lifetime of the firearm and a tool lifetime. According to an exemplary further development, an averaged hardness of the guide band over its entire radial depth, in particular up to the cavity, is softer, in particular at least 10%, at least 15% or at least 20% softer, than that averaged hardness if the projectile were made of a solid intermediate.

In a further exemplary embodiment of the present disclosure, the bullet rear in the axial projection of the cavity, i.e. on the rear side of the cavity, has a solidified core region, extending in the longitudinal direction of the projectile, in particular up to the bullet bottom, with a higher average hardness than bullet rear regions adjacent to the core region, whose average hardness of which corresponds to at least 140%, in particular at least 150% or at least 160%, of that average hardness if the projectile were made from a solid intermediate.

In another exemplary embodiment of the present disclosure, combinable with any of the preceding aspects and exemplary embodiments, the material of the projectile and/or intermediate is copper, aluminum, iron, such as soft iron, silver, titanium, tungsten, tin, zinc, magnesium, lead, cadmium, or alloys thereof.

According to another aspect of the present disclosure, which can be combined with the preceding aspects and exemplary embodiments, a tool for pressing an intermediate inserted in a, in particular a cylindrical, die, which has a tube section with a cavity of substantially constant diameter, is provided for producing a projectile having a caliber ranging from 4.6 mm to 20 mm, in particular according to one of the aspects or exemplary embodiments previously described.

The tool can basically be made of a rigid, in particular inelastic, material and, for example, consist of one piece.

The tool comprises a holding section at which an operator or a machine can hold and operate the tool. Furthermore, the tool has a forming section tapering in the direction away from the holding section and having a tip, an elongated, at least sectionally curved, in particular concave-shaped, or conically-shaped guide part adjoining the tip, for guiding the tool within the cavity of the intermediate, and an, in a projection-free manner adjoining, at least sectionally curved, in particular concave-shaped, or conically-shaped press part, having a different inclination to the longitudinal axis of the tool than the guide part. The guide part of the forming section arranged adjacent to the tip serves to guide the tool within the cavity of the intermediate. Guiding the tool within the cavity of the intermediate has several advantages. Firstly, it is accompanied by a kind of self-centering, which results in particularly high precision. Secondly, due to the aligned tool movement in the direction of the longitudinal axis of the cavity it is reliably ensured that, an essential aspect of the present disclosure, namely being able to apply lower pressing forces and to use more delicate tools, is maintained.

According to an exemplary further development, the inclination of the outer surface of the press part with respect to the longitudinal axis of the tool is greater than the inclination of the outer surface of the guide part with respect to the longitudinal axis of the tool. In particular, this makes it possible to produce a particularly delicate tool in which the guide part is configured thin and very elongated, so that it is possible to reach deeply into the cavity of the intermediate. By means of the tool according to the disclosure, it withstands a plurality of pressing operations, in particular at least 100, 300, 500, 700 or at least 1000, pressing operations.

According to another exemplary embodiment of the tool according to the disclosure, an axial length of the guide part is matched to an inner dimension of the intermediate in such a way that the tool has an outer dimension of up to 1.4 times the diameter of the cavity at the transition from the guide part to the press part. For this geometric matching, a particularly good guiding of the tool within the cavity of the intermediate is ensured.

According to a further exemplary embodiment of the tool according to the disclosure, an axial length of the guide part and/or the press part is at least 80% of a maximum radial distance of the cavity. In particular, the axial length of the guide part can be at least as large, at least 1.5 times as large or even at least twice as large, as the maximum radial distance of the cavity of the intermediate.

According to a further exemplary embodiment of the tool according to the disclosure, its cross-section is point-symmetrical, in particular in the region of the guide part and/or the press part, and deviates from a circular shape. In other words, any regular or irregular point-symmetrical shapes can be considered for the outer cross-section of the guide part and/or the press part, which can be selected depending on the desired inner geometry of the projectile to be produced.

According to a further aspect of the present disclosure, which is combinable with the preceding aspects and exemplary embodiments, there is provided a method of manufacturing a projectile, in particular according to one of the aspects or exemplary embodiments described above, with a caliber in the range of 4.6 mm to 20 mm.

According to the method according to the disclosure, an intermediate with a tube section of substantially constant wall thickness is inserted into a, in particular cylindrical, die, and the intermediate is cold-formed, in particular press cold-formed, in particular by means of extrusion, by means of a tool in particular according to one of the aspects of the disclosure described above, in such a way that, at least sectionally, the outer diameter of the intermediate remains substantially constant and determines the projectile caliber. By means of the method according to the disclosure, it is possible to select the intermediate for producing the projectile in such a way that its initial outer dimension is substantially close to the caliber of the projectile to be produced, so that the metal material in the region of the outer diameter, i.e. near the surface, is hardly solidified and deformed, such that an unsolidified metal structure results, which improves the precision and/or the desired deformation and/or ballistic properties of the projectile.

According to another aspect of the present disclosure, which is combinable with the preceding aspects and exemplary embodiments, there is provided a method adapted to produce a projectile according to the disclosure.

According to another aspect of the present disclosure, which is combinable with the preceding aspects and exemplary embodiments, a tubular metallic intermediate, in particular of copper, aluminum, iron, such as soft iron, silver, titanium, tungsten, tin, zinc, magnesium, lead, cadmium or an alloy thereof is used to manufacture a projectile, in particular according to the disclosure, such as a deformation bullet, a partial fragmentation bullet, a partial or full jacket bullet, hard-core projectile or a tracer projectile, with a caliber in the range of 4.6 mm to 20 mm for ammunition.

The basic idea underlying the present disclosure, in particular using of a substantially exclusive cold forming process for manufacturing a projectile using a tubular intermediate, that is, using an intermediate which has a tube section which constitutes substantially 50% of the longitudinal extension of the intermediate, it is possible to create a particularly precisely manufactured projectile and a projectile manufacturable with delicate tools, in a simple manner in terms of manufacturing technology, whereby a lower working pressure is required than is the case in the prior art.

In an exemplary embodiment, a tool configured according to the disclosure is used.

In the following description of exemplary embodiments of the present disclosure, a projectile according to the disclosure is generally designated by reference numeral 1, a pressed part according to the disclosure is generally designated by reference numeral 10, and a tool according to the disclosure is generally designated by reference numeral 100.

With reference to FIGS. 1 and 2, an exemplary embodiment of an intermediate 3 or a countersunk intermediate 5, which serves as a bullet blank, with a tube section 4, is shown. The starting material for the intermediate 3 is preferably rod or wire material. The inner tube surface 39 of the intermediate 3, which has a tube section 4 with substantially constant wall thickness, is defined in particular by the central cavity 45 of the tube section 4. The tube section 4 is manufactured in particular by means of shearing, cutting, vibratory grinding or adiabatic separation. The resulting intermediate planar surfaces 25, which are preferably cleanly separated, limit the intermediate length in the longitudinal direction L. The intermediate planar surfaces 25 of the intermediate 3 may have different or identically shaped intermediate planar surfaces 25 due to countersinking 19 on one or both sides (FIG. 2). A fundamental idea of the present disclosure is to manufacture a projectile 1 from a tubular intermediate 3, instead of from a solid wire blank as before. In FIG. 1, the thick wall thickness of the intermediate 3, which according to the exemplary embodiment consists entirely of a tube section 4, is apparent, wherein an inner diameter of a tube section is about ⅓ of an outer diameter of a tube section and is substantially constant. The tube section represents at least 50% of the longitudinal extension of the intermediate 3.

With reference to FIG. 3, an exemplary embodiment of a cylindrical die 7 for manufacturing a preform 9 or for pressing the bullet bottom 17 while forming the rear chamfer 61 is explained.

The die 7 comprises a rotationally shaped die-cylinder inner surface 93 with a central front side 101. As can be seen in FIG. 3, the front side 101 of the cylindrical die 7 and the taper 95 towards the ejector side of the die 99 are responsible for forming the preform 9 and for closing the inner tube surface 39 of the bullet rear 51. As can be seen in FIG. 3, the pressed part 10 already has a formed, in particular convexly formed, inner wall surface 71 which is manufactured by means of a tool 100 according to the disclosure.

A projectile 1 according to the disclosure is shown in a sectional view in FIG. 4. The projectile 1 comprises a bullet body 13 which is manufactured in one piece and is made in particular of homogeneous material, for example ferrous material or non-ferrous material, in particular a non-ferrous metal, in particular a copper alloy. The integral construction of the projectile 1 shown in FIG. 4 has a positive effect on the manufacturing tolerances, this has a positive effect on the unbalance and thus on the bullet precision. The bullet body 13 comprises a conical bullet rear 51 and an ogive-like tapering bullet front 53. The bullet front 53 is formed by a circumferential front wall 41, which encloses a central cavity 45 open towards the front of the projectile 1. By bending of the ogive-shaped bullet front 53, a front fold 33 in the front wall 41 is created.

With regard to internal ballistics, the guide band 63, the configuration of the cavity 45 and the choice of material and its hardness are of particular interest. The choice of material is preferably one that nestles into the land-groove-profile of the firearm barrel with little resistance so that the projectile can be accelerated efficiently. Here, the guide band 63, which is in contact with the actual land-groove-profile, is important. In addition to the obvious material parameters such as hardness and temperature resistance, the diffusion coefficient of the guide band 63 should also be as impermeable as possible to the partner material of the barrel to prevent cold welding. Low-resistance penetration of the projectile into the land-groove-profile can be realized not only by the material properties but also by the configuration of the cavity 45. The cavity 45 creates an elastic deflection possibility, which further reduces the press-through resistance.

With regard to the external ballistics of the projectile 1 shown in FIG. 4, the bullet rear 51 and the rear chamfer 61 are of particular interest. The bullet rear can be configured to geometrically narrow tolerances by the manufacturing process in a die 7; reproducible geometrically narrow tolerances in the rear mean high precision in bullet flight. The rear chamfer 61 has an influence on the aerodynamic vortex shedding during bullet flight and can thus influence the aerodynamic drag. The bullet front 53 and the tip 29 also influence the aerodynamics. Here, a narrow ogive and a thin tip mean a variant with lower aerodynamic resistance.

The projectile 1 shown in FIG. 4 can comprise a deformation bullet, a partial fragmentation bullet or a partial jacket bullet, which can be configured to meet the application-specific requirements, in particular those of terminal ballistics. Despite the integral construction of the projectile 1 of FIG. 4, there are structural and geometric modification possibilities. The diameter of the opening 35 of the projectile 1 has a significant influence on the hydrostatic pressure on the inside of the cavity 45 of the projectile, which occurs when the projectile 1 penetrates a wound ballistic, also called a gelatinous mass. This hydrostatic pressure ultimately has an influence on the deformation characteristics of the projectile 1 and thus on the energy output in the target. A large opening diameter means a high hydrostatic pressure and a fast response in the gelatinous mass, whereas a smaller diameter means a slightly delayed response. The wall thickness of the tip 29 counteracts the opening diameter 35, the greater the wall thickness, the greater the hydrostatic pressure must be, to be able to achieve an increased energy release effect in the gelatinous mass. The number and shape of the wall slots 43 determine the breakup behavior of the projectile 1; the more acutely angled the wall slots 43 are, the stronger their notch effect is, which leads to a radial weakening of the bullet front 53 and to a faster deformation of the projectile 1 in the gelatinous mass. The configuration of the cavity 45 has an influence on the diameter increase of the projectile 1 after impacting the gelatinous mass. A short cavity 45 leads to a smaller deformation at the bullet front-side 53, which leads to a reduced energy release in the gelatinous mass. In the case of an elongated cavity 45, which, as can be seen in FIG. 4, extends in the longitudinal direction L from the opening 35 to the bullet rear 51, an increased energy release and thus reduced penetration depth in the gelatinous mass is realized.

With reference to FIGS. 5 to 8, which show a stage plan for manufacturing a projectile 1 according to the disclosure, the individual manufacturing steps of the final projectile 1 shown in FIG. 8 first become apparent.

First of all, an intermediate 3 made of metal, preferably a non-ferrous metal or ferrous metal, is provided (FIG. 5), which is obtained from continuous tube raw material or bar material such as a tube, by cutting. The intermediate 3 consists in particular of a homogeneous material and is constructed integrally.

In a first manufacturing step, the intermediate 3 is formed into a preform 9 by setting, in particular cold formed, for example by pressing or extrusion (FIG. 6). As can be seen from a comparison of FIGS. 5 and 6, the setting process is accompanied by an expansion in length of the intermediate 3, wherein the outer diameter substantially corresponds to the caliber of the projectile 1. The increase in length and diameter results from the central tapering cavity section 75 introduced during setting, which extends from one end face 31 of the preform 9, through the preform 9, to the opposite end face 37 of the preform 9. The introduction of wall slots 43 by a segmented tool 100 causes a material displacement, which manifests itself in a length expansion, in particular in the direction of the end face 31. The tapering cavity section 75, which is located at the opposite end face 37, is formed by a, in particular convex shaped, wall inner surface 71. The setting can be carried out by means of a tool-die arrangement, wherein the outer geometry of the tool 100 determines the geometry of the cavity section 65. At the same time, wall slots 43 oriented in the longitudinal direction L of the preform 9 or of a pressed part 10 are introduced by cold-forming, on an inner wall surface 71 of the preform 9, which will be explained in detail later.

After setting, the preform 9 is prepressed to form the pressed part 10 according to the disclosure (FIG. 7). Between the stage of the preform 9 and the intermediate 3, that is after the setting and before the prepressing, the blank is turned over. In this case, a machine turning operation is required. The preform 9 is cold-formed in the direction of the end face 31 of the preform 9 to form the pressed part 10, so that an ogive-like bullet front 53 is formed by compressing the front wall 41. During prepressing, the front wall 41 is also cold-formed on the outside to form, in particular with formation of front folds 33, a front wall 41 that tapers in an ogive-shape at least sectionally. As a result of the front wall 41 tapering in the direction of the tip 29, the wall thickness of the section forming the subsequent bullet front 53 increases compared to the original front wall 41 of the preform 9.

The pressed part 10 produced in this way consists of a metal body 113 of, in particular, homogeneous material, preferably ferrous or non-ferrous material, and is then further cold-formed to form a bullet body 13 shown in FIG. 8, which for the most part already has the complete geometry of the final projectile 1. Starting from the pressed part 10, the bullet body 13 is sharpened in the longitudinal direction L, so that the narrowest possible tip 29 of the projectile is formed, whereby the internal geometry of the central cavity 45 directly behind the opening 35 is changed, in particular in the direction of the bullet rear 51 widened, and in particular formed into a thin channel. By pressing in a second, in particular convexly configured, tool 100, a rear cavity 21, which is delimited in the longitudinal direction of the bullet in the direction of the bullet front 53 by a rear cavity base section 59, is additionally formed. As a result of the pressing process by means of tool 100, the material of the hollow cylinder 65 flows along the tool 100 and thus defines the rear cavity wall thickness b in FIG. 9. The rear cavity 21 is formed by a hollow cylinder 65 and delimited by a hollow cylinder inner surface 67. In a later stage, not shown, the rear cavity 21 may be filled with a further material. This material may comprise a ferrous metal, a non-ferrous metal, a polymer or a mixture (compound) of polymer and metal powder and serves to tare weight and center of gravity or to increase penetration. Furthermore, it is conceivable to introduce a tracer mixture, a pyrotechnic composition or explosive into the rear cavity 21, thereby enabling visual tracking of the projectile trajectory and/or target marking. Due to the small volume of the rear cavity, in particular nanoscale explosives such as nanothermites are used as explosives.

With reference to FIGS. 9 to 12, which illustrate a further stage plan for manufacturing a projectile 1 according to the disclosure, the individual manufacturing steps of the final projectile 1 shown in FIG. 12 are first apparent.

First of all, a tube-intermediate 3 made of metal, preferably a non-ferrous metal or ferrous metal, is provided (FIG. 9), which is obtained from continuous tube raw material or bar material, such as a tube, by cutting. The intermediate 3 consists in particular of a homogeneous material and is constructed integrally.

In a first manufacturing step, the intermediate 3 is formed into a preform 9 by setting, in particular cold formed, for example by pressing or extrusion (FIG. 10). As can be seen from a comparison of FIGS. 9 and 10, the setting process is accompanied by an expansion in length of the intermediate 3, wherein the outer diameter substantially corresponds to the caliber of the projectile 1. The increase in length and diameter results from the central cavity section 75 introduced during setting, which is initially cylindrical in the longitudinal direction L and then tapering, extending from one end face 31 of the preform 9 through the preform 9 to the opposite end face 37 of the preform 9. The introduction of the wall slots 43 by the segmented tool 100 causes a material displacement which manifests itself in a length expansion, in particular in the direction of the end face 31. The cavity section 75, which is initially cylindrical in the longitudinal direction L and then tapering, and which extends to the opposite end face 37, is formed by a concavely shaped inner wall surface 71. The setting can be carried out by means of a tool-die arrangement, wherein the outer geometry of the tool 100 determines the inner geometry of the hollow cylinder 65. The central cavity 45 of FIG. 10 has a larger volume compared to FIG. 6, from which other ballistic properties such as full jacket bullet-like penetration properties result. At the same time, wall slots 43 oriented in the longitudinal direction L, respectively in the pressing direction P of the preform 9 or the pressed part 10, respectively, are introduced by cold-forming on the inner wall surface 71 of the preform 9, which will be explained in detail later.

After setting, the preform 9 is prepressed to form a pressed part 10 (FIG. 7). Between the stage of the preform 9 and the pressed part 10, that is after the setting and before the prepressing, the blank is turned in a turning operation. The preform 9 is cold-formed in the direction of the end face 31 of the preform 9 to form the pressed part 10, so that an ogive-like bullet front 53 is formed by compressing the front wall 41. During prepressing, the front wall 41 is also cold-formed on the outside to form a front wall 41 that tapers in an ogive-shape at least sectionally. As a result of the front wall 41 tapering in the direction of the tip 29, the wall thickness of the section forming the later bullet front 53 increases compared to the original front wall 41 of the preform 9, and the cavity 45 formed during setting has a rotationally ellipsoidal structure due to the concave configuration of the tapering cavity section of the preform 9.

The pressed part 10 produced in this way consists of a metal body 113 of, in particular, homogeneous material, preferably ferrous or non-ferrous material, and is then further cold-formed to form a bullet body 13 shown in FIG. 12, which for the most part already has the complete geometry of the final projectile 1. Starting from the pressed part 10, the bullet body 13 is sharpened in the longitudinal direction L, so that the rotationally ellipsoidal cavity 45 of the projectile 1 in FIG. 12 is narrower than in FIG. 11. By pressing in a second, in particular concavely configured, tool 100, a rear cavity 21, which is delimited in the longitudinal direction of the bullet in the direction of the bullet front 53 by a rear cavity base section 59, is additionally formed. As a result of the pressing process by means of tool 100, the material of the hollow cylinder 65 flows along the tool 100 against the pressing direction P and thus defines the rear cavity wall thickness b of FIG. 12. The rear cavity 21 is formed in the radial direction by a hollow cylinder 65 and is delimited by a hollow cylinder inner surface 67. The cylindrical rear cavity 21 is delimited from the central cavity 45 by a central constriction 27. In a later stage, not shown, the rear cavity 21 may be filled with a further material. This material may comprise a ferrous metal, a non-ferrous metal, a polymer or a mixture (compound) of polymer and metal powder and serves to tare weight and center of gravity or to increase penetration. Furthermore, it is conceivable to introduce a tracer mixture, a pyrotechnic composition or explosives into the rear cavity 21, thereby enabling visual tracking of the projectile 1 trajectory and/or target marking. Due to the small volume of the rear cavity, in particular nanoscale explosives such as nanothermites are used as explosives.

With reference to FIGS. 13 to 16, which show a further stage plan for the manufacture of a projectile 1 according to the disclosure, the individual manufacturing steps of the final projectile 1 shown in FIG. 16 are first apparent, wherein only the differences to the preceding explanations are being described.

The increase in length and diameter results from the central cavity section 75, which is introduced during setting and tapers in the direction of the opposite end face 37, and which extends from a sharp edge 23 of the preform 9 through the preform 9 to the opposite end face 37 of the preform 9. The pressing in of the conical tool 100 causes a material displacement, which manifests itself in a length expansion, in particular in the direction of the end face 31. The tapered cavity section 75, located at the opposite end face 37, is formed by a conically shaped inner wall surface 71. The setting can be carried out via a tool-die arrangement, whereby the outer geometry of the conical tool 100 determines the geometry of the cavity section 65.

Between the stage of the preform 9 and the pressed part 10, i.e. after the setting and before the prepressing, the blank is turned. In this case a, in particular mechanical, turning operation is required. The preform 9 is cold-formed in the direction of the sharp edge 23 of the preform 9 to form the pressed part 10, so that a preliminary stage of a bullet front 53 is formed by compressing the front wall 41. During prepressing, the front wall 41 is also cold-formed on the outside to a front wall 41 that tapers at least sectionally. Due to the preferably symmetrically introduced front-sided and rear-sided conical cavities, material is accumulated on the front side of the conical tool 47 by the insertion process of the punch. A central constriction 27 is created which completely separates the two conical preferred cavities.

The pressed part 10 manufactured in this way consists in particular of a metal body 113 of homogeneous material, preferably of ferrous or non-ferrous material, and is then further cold-formed to form a bullet body 13 shown in FIG. 15. Starting from the pressed part 10, a material is filled into the cavity sections 75 front- and rear sided, which is preferably soft and ductile and has a high material density. The rear filler 117 can influence the penetration property of the projectile 1, for example, if a hard rear filler is taken, the projectile 1 can penetrate deeper. The front filler 119 is preferably made of a ductile metal such as lead or tin and can influence the front deformation mechanism. The bullet body 13 is sharpened starting from the pressed part 10 in longitudinal direction L, so that a tip 29 of the projectile is realized.

A schematic representation of a launched, deformed projectile 33, which results from launching a projectile 1 according to the disclosure and impacting the projectile 1 on a target, in particular a standard target such as a gelatinous mass, is shown in FIGS. 17 and 18.

The deformed projectile 49 differs from prior art projectiles in particular in the formation of segment flags 111 which are bent radially outward upon impact with a target. As can be seen in FIGS. 17 and 18, the front wall 41 is torn open along the wall slots 43 and the outer jacket surface 87 is turned outward, leaving the cavity base section 57 intact. Thus, a spider-like deformed bullet is created that is greatly expanded with respect to the longitudinal axis of the bullet, causing increased resistance when penetrating the gelatinous mass, thus increasing energy output and reducing penetration depth.

The deformation behavior results, on the one hand, from the cold forming and the geometry of the central cavity 45 and, on the other hand, from the wall slots 43 introduced into the inner wall surface 71 of the preform 9, which remain as slots on the final projectile 1 on the inner wall surface 71 of the bullet front 53. The cold forming increases the strength of the inner wall surface 71 transverse to the longitudinal direction L compared to the strength of the inner wall surface 71 in the longitudinal direction L, and the wall slots 43 allow the deformation behavior to be controlled in a targeted manner. The impact velocity at which the projectile 1 begins to deform, also referred to as the response behavior, is determined by the diameter of the opening 35. As can be seen in FIG. 17, the projectile 1 in FIG. 17 has bent segment flags 111. Upon impact with a target, the front wall 41 opens along the wall slots 43, while only the bullet rear 51 with the cavity base section 57 remain largely undeformed. The length, number and depth of the wall slots 43 can be used to selectively adjust how far the front wall 41 opens and thus how great the widening and bending of the segment flag 111 is. In this way, the deformation behavior of the projectile 1 can be changed independently of the strength of the front wall 41. This means that expensive heat treatment processes, such as annealing, can be dispensed with after cold forming, and thus the projectile 1 according to the disclosure can be manufactured in a particularly simple and cost-effective manner.

In addition to the geometric effects which cause different deformation behavior when penetrating the gelatinous mass, the impact velocity of the projectile 1 on the gelatinous mass is also responsible for the final shape of the deformed projectile 49. FIG. 17 shows, for example, a deformed bullet which has impacted at high velocity. The segment flags 111 are correspondingly more bent over due to the hydrodynamic pressure. In FIG. 18, a projectile 1 is shown with a bullet-typical impact velocity, which deforms the segment flags 111 to a lesser extent on impact. At a different impact velocity, the segment flags 111 are deformed more strongly parallel to the longitudinal direction L, which corresponds to FIG. 17.

When the projectile impacts the gelatinous mass, a large hydrodynamic bullet opening pressure is generated, which leads to deformation of the projectile in the gelatinous mass. If this bullet opening pressure is maintained over long distances, this can lead to the tearing off of one or more segment flags 111. To prevent this, the distance between the bullet bottom 17 and the cavity base section 57 can be designed to implement a rupture-disc-like overpressure valve which can be used to relieve the excess bullet opening pressure. The hole in the bullet bottom resulting therefrom not only reduces the bullet opening pressure, but also has stabilizing effects in the gelatinous mass.

With reference to FIGS. 19 to 33, exemplary embodiments of tools 100 according to the disclosure are explained. In the embodiments according to FIGS. 19 to 23, the tool 100 is cylindrically shaped and rotationally symmetrical with respect to the longitudinal axis L of the tool 100. Tools 100 according to the disclosure basically have a holding section 107 for gripping, clamping or the like of the tool 100 and a tapering forming section 108 adjoining the holding section 107, which may also be referred to as a press head, with a press tip/guide tip 85, an elongated, at least sectionally concave shaped or conically shaped guide part 79 adjoining the press tip/guide tip 85 for guiding the tool 100 within the cavity 45 of the tube section 4, and an, in a projection-free manner adjoining, at least sectionally concave shaped or conically shaped press part 80 adjoining the press part having a different inclination to the longitudinal axis of the tool.

In the side view in FIG. 20, it can be seen that the conically shaped press part 80 and the conically shaped guide part 79 of the tool 100 have six polygonal segment edges 77 at an outer jacket surface 87, which are evenly distributed in the circumferential direction, in the radial direction from the outer jacket surface 87, thus being polygonal shaped in cross-section. The pressed part 80 leads into the guide part 79 in a projection-free manner. The segment edges 77 extend to the concave forming section 89 and the convex forming section 91 along the longitudinal direction L at the planar regions 105 of the press head 108. The segment edge 77 of the press head 108 may have concave forming sections 89 and convex forming sections 91 (FIGS. 19 and 20), exclusively concave forming sections 89 (FIG. 21) or exclusively convex forming sections 91, depending on the embodiment.

In FIG. 19 to FIG. 21, it can be seen that the tool shank 83 of the tool 100 transitions in the longitudinal direction L from a round region 107 forming a holding section via a transition region 103 into a pressing flank-forming plane region 105. In order to ensure centering of the press head 108 in the tube cavity 55 of the intermediate 3, the press head 108 is equipped with a press tip/guide tip 85 which can be segmented analogously to the number of segment edges 77. In the tool 100 according to the disclosure, the axial length of the guide part 79 is matched to the inner dimension of the tube section 4 in such a way that the tool has an outer dimension of up to 1.4 times the diameter of the cavity at the transition from the guide part 79 into the press part 80. Furthermore, the part of the tool 100 in contact with the intermediate 3 is configured in such a way that the axial length of the guide part 79 and/or the press part 80 is at least 80% of a maximum radial distance of the cavity.

FIG. 22 shows an unsegmented press head 108 according to the disclosure, with unsegmented press tip/guide tip 85. FIG. 23 shows a tool 100, which has a polygonal shaped face 97 and rectangularly shaped segment flanks 81.

FIGS. 24 and 26 show a star-shaped inner wall surface with a different number of partial segments 73.

FIGS. 25 and 27 show a polygonal inner wall surface with a different number of partial segments 73.

Figure 28:
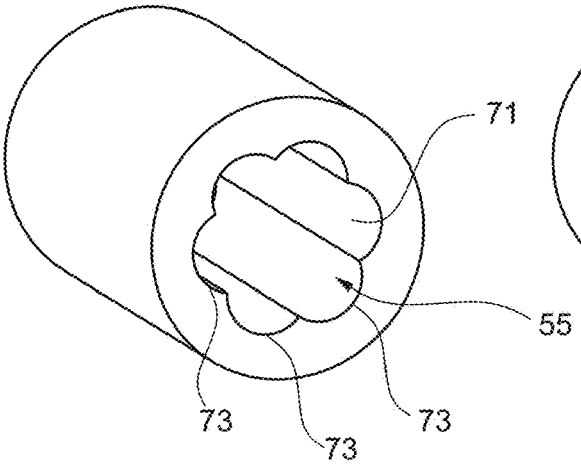
Figure 30:
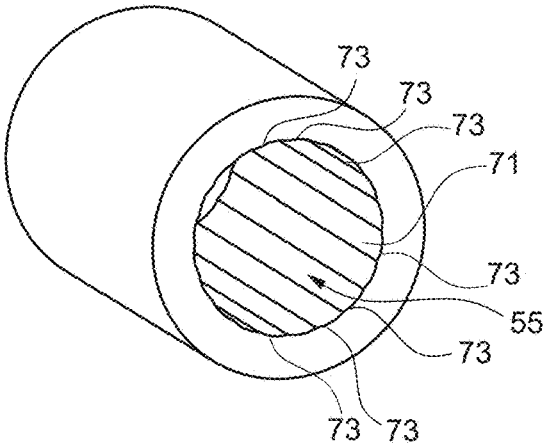

FIGS. 28 and 30 show an inner wall surface with arcuate partial segments 73 having a different number of partial segments 73.

Figure 29:
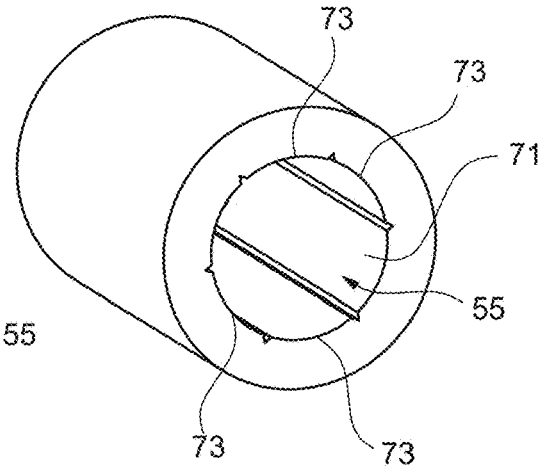
Figure 31:
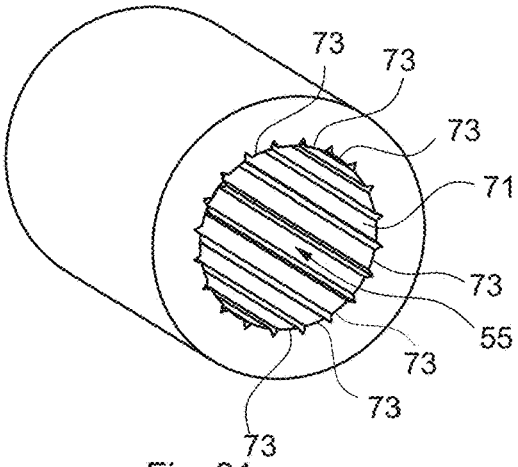

FIGS. 29 and 31 show a V-shaped-notched wall inner surface with a different number of partial segments 73.

Figure 32:
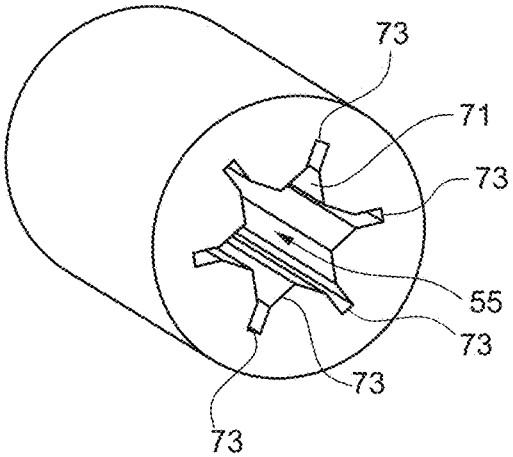
Figure 33:
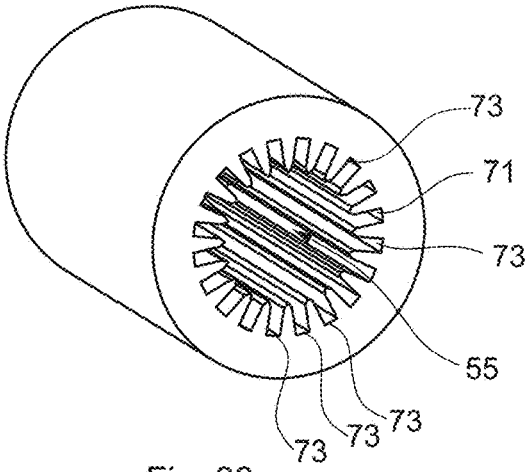

FIGS. 32 and 33 show a rectangular notched wall inner surface with a different number of partial segments 73.

A general advantage of the present disclosure is that the inner shape can be adapted very flexibly in tube extrusion. In particular, any internal geometries with different deformation properties can be easily manufactured in conjunction with the press head.

Figures 34, 35:
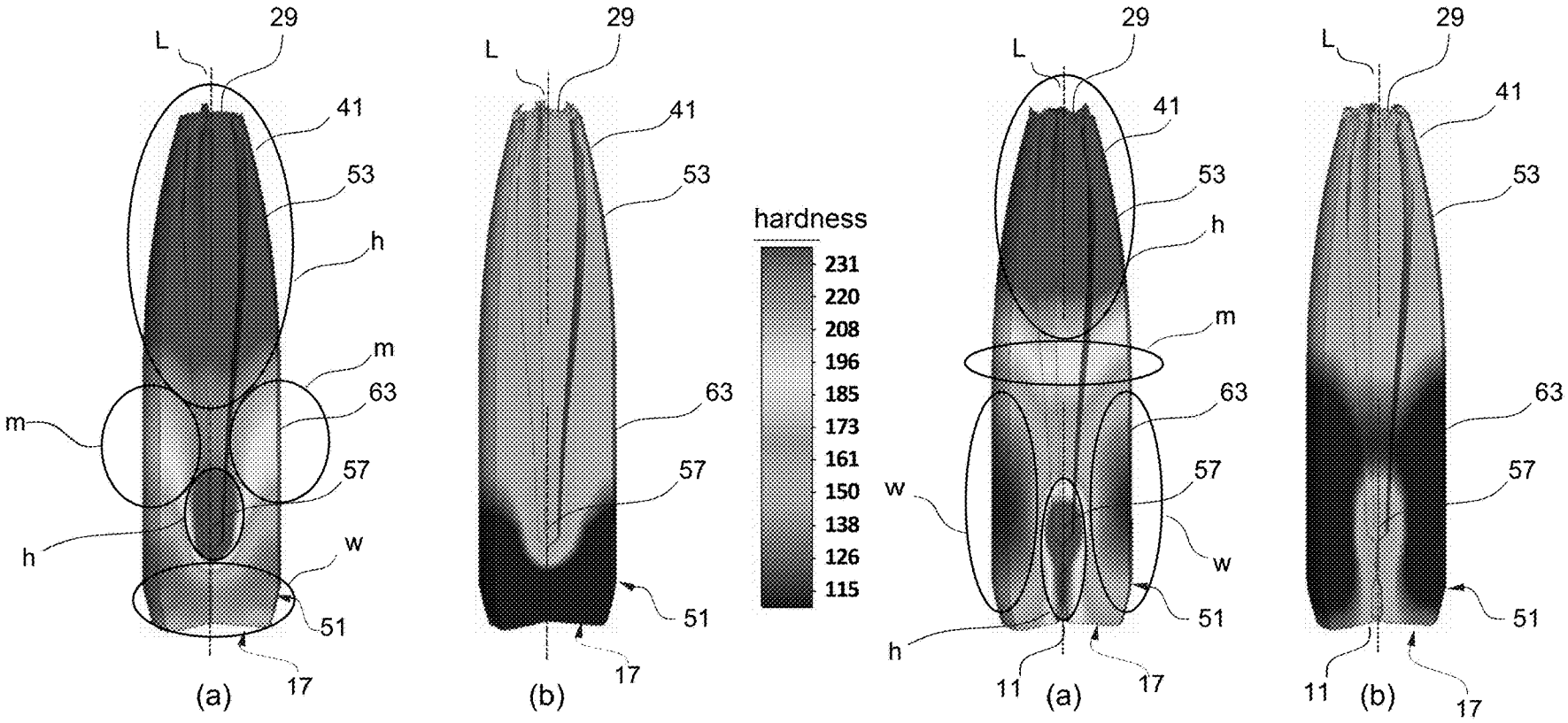

Metals, in particular non-ferrous metals, have the property of becoming harder due to deformation. This means that a large deformation leads to a large increase in the hardness of the raw material. On the basis of hardness profile figures, as shown in FIGS. 34 and 35, indirect conclusions can be drawn about the degree of formation and the production process.

Figure 1:
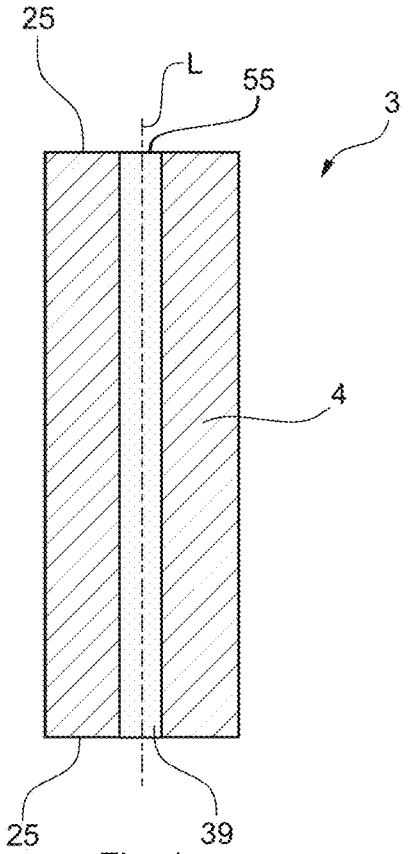
Figure 2:
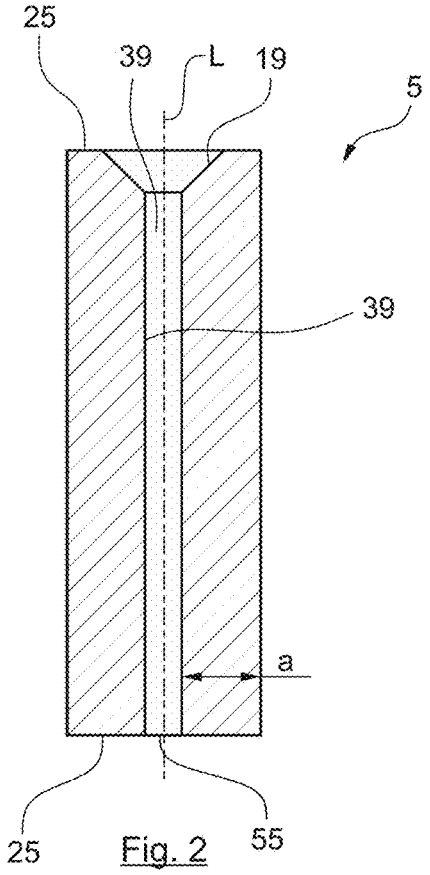
Figure 3:
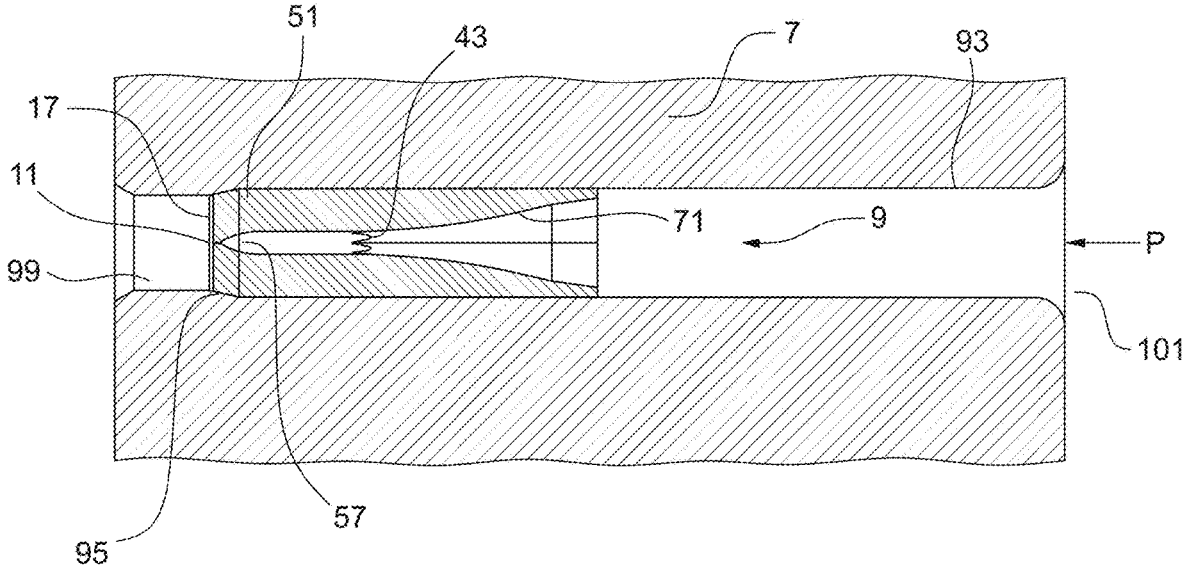
Figure 4:
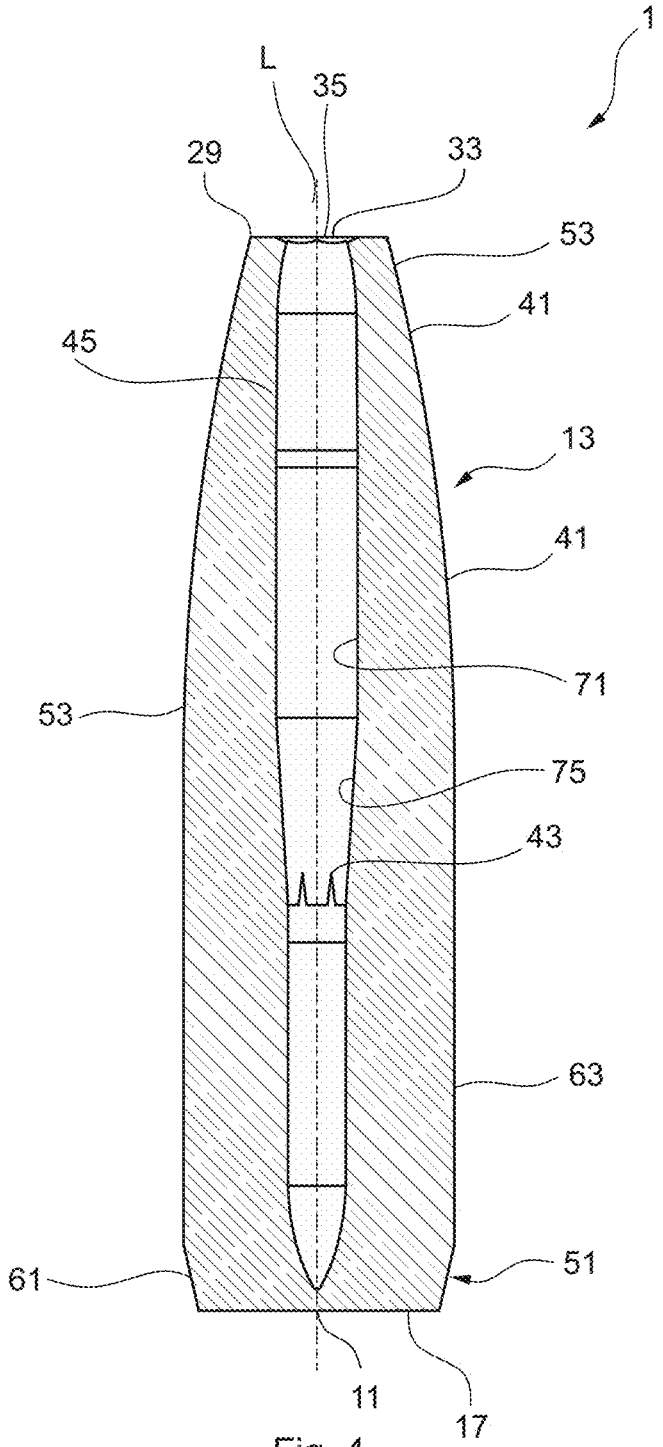
Figure 5:
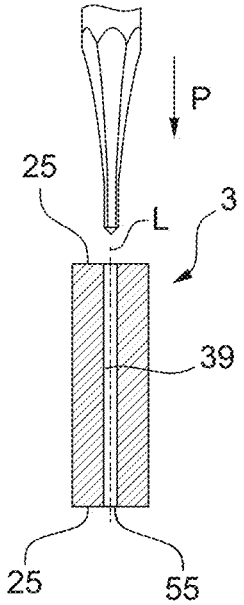
Figure 6:
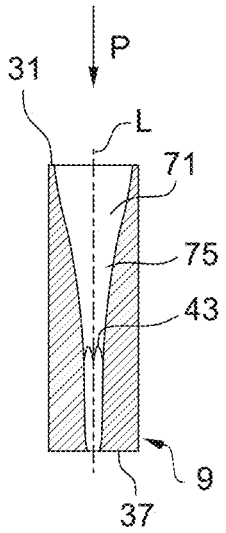
Figure 7:
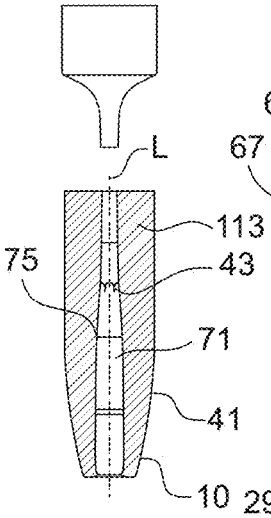
Figure 8:
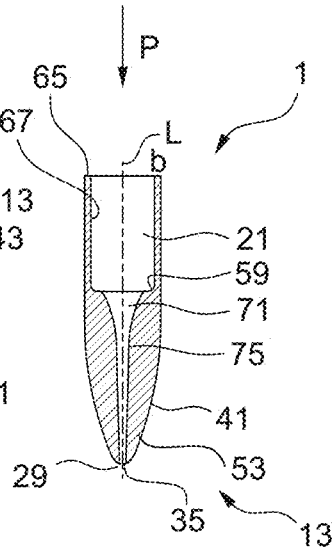
Figure 9:
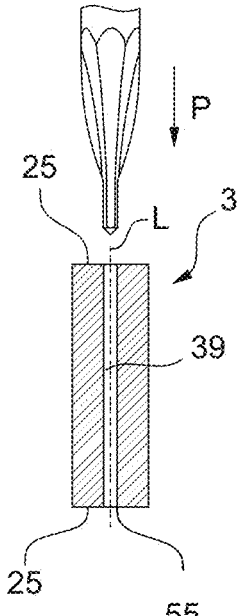
Figure 10:
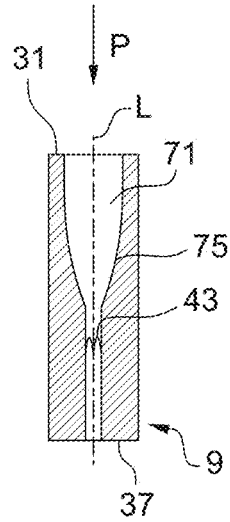
Figure 11:
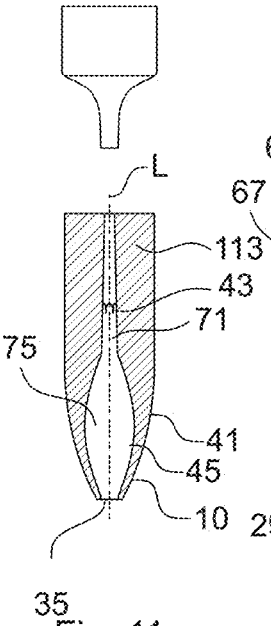
Figure 12:
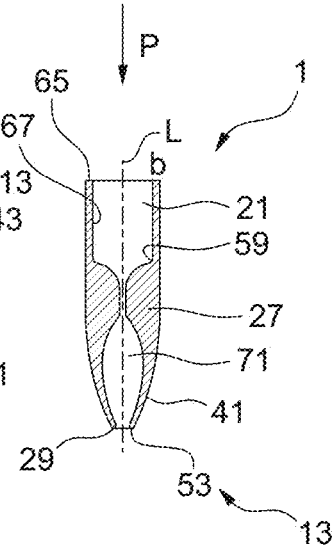
Figure 13:
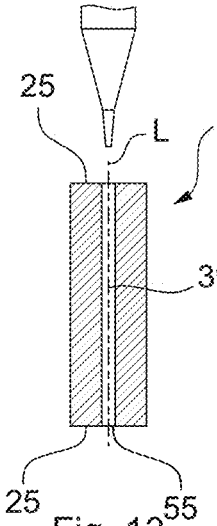
Figure 14:
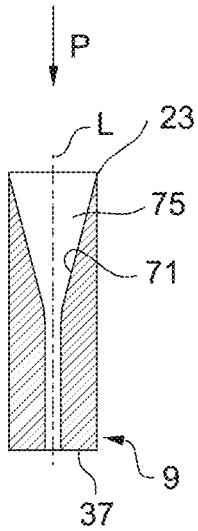
Figure 15:
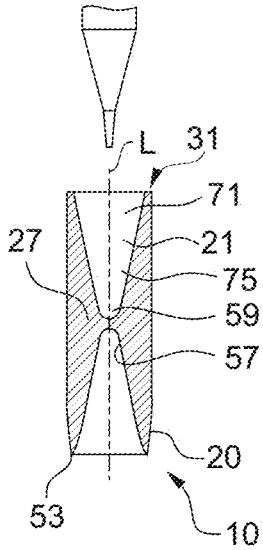
Figure 16:
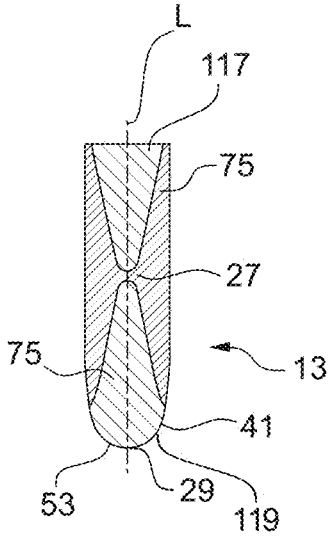
Figure 17:
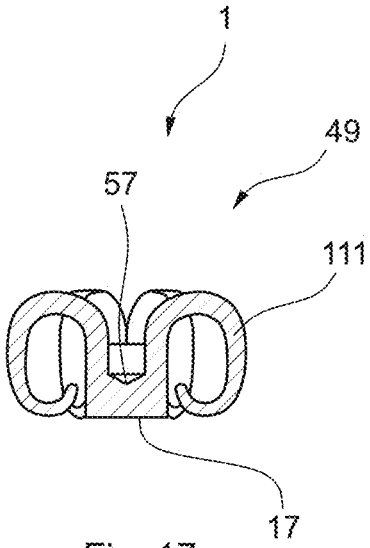
Figure 18:
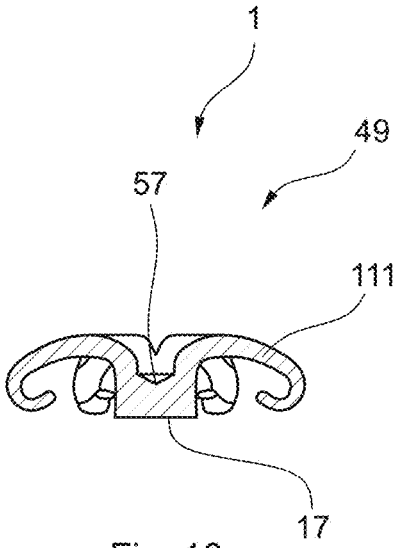
Figure 19:
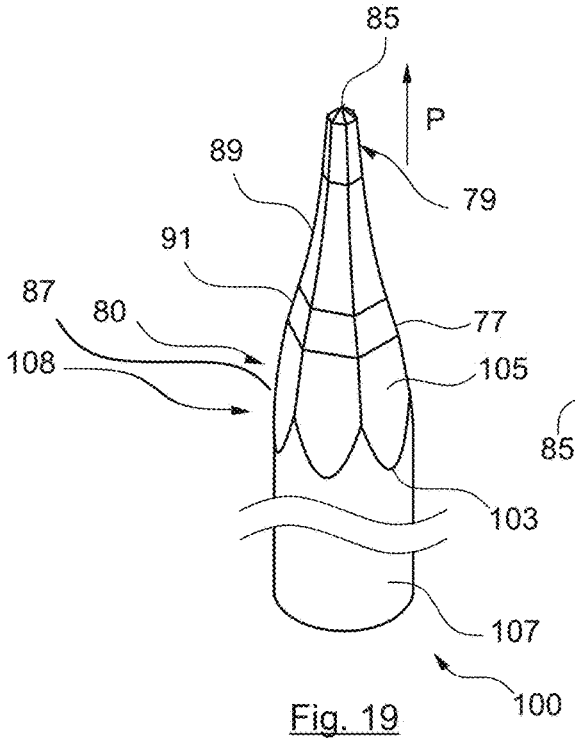
Figure 20:
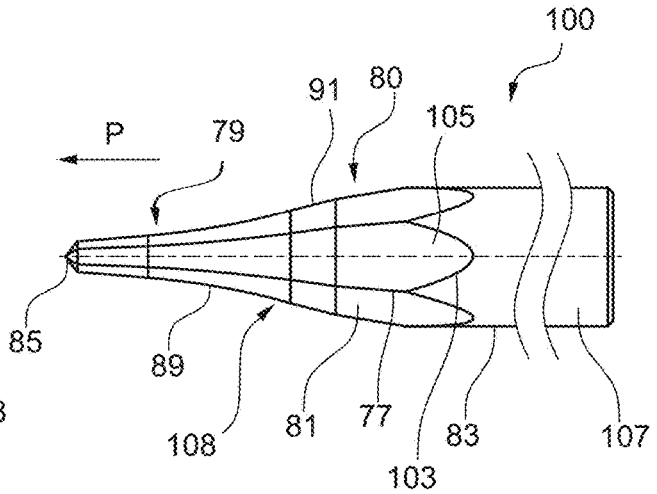
Figure 21:
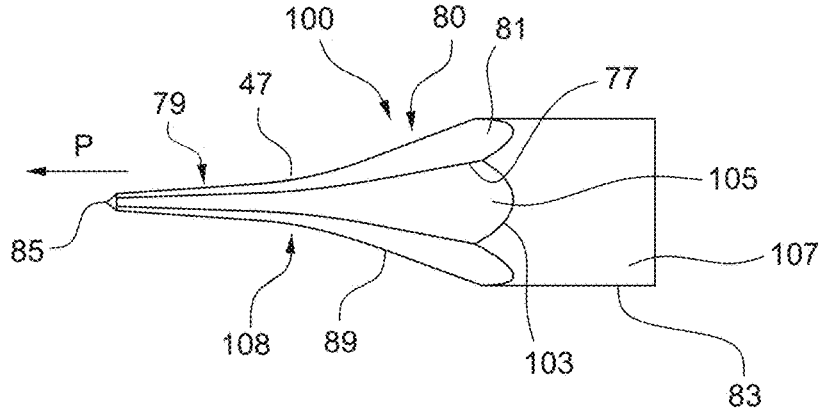
Figure 22:
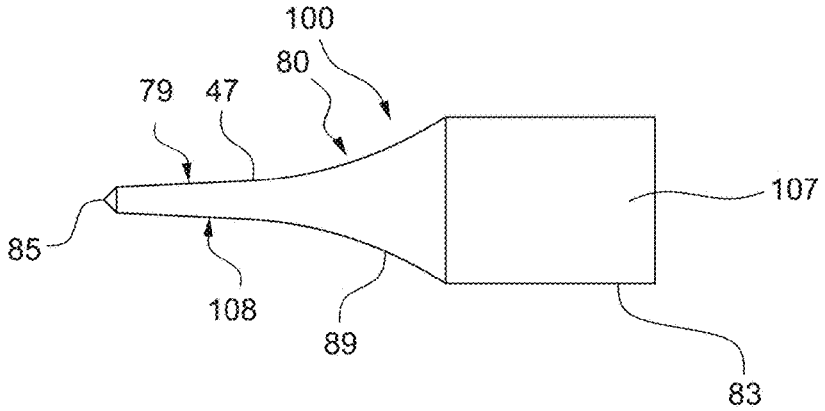
Figure 23:
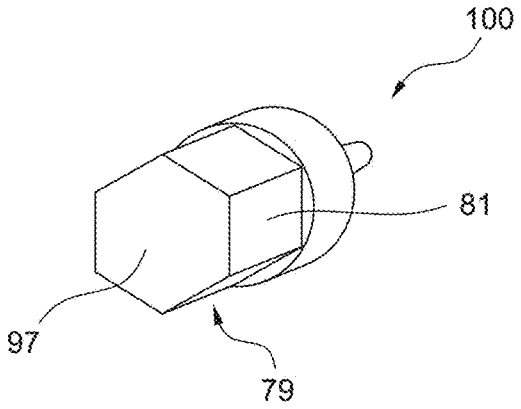
Figure 24:
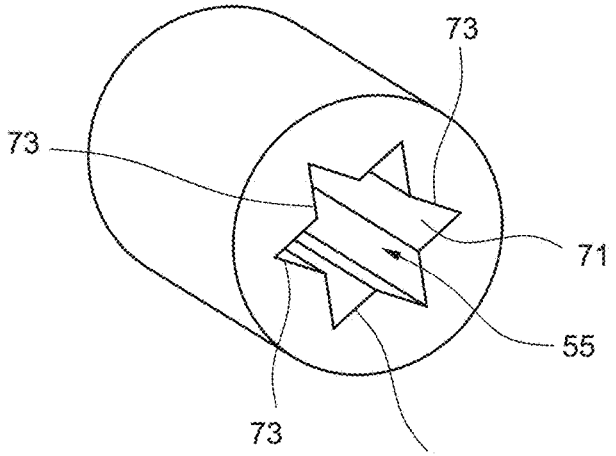
FIGS. 24 to 33 show schematic cross-sectional views of intermediates showing the inner cross-sectional shape of the tube cavity 55. The tube cavities 45 are point-symmetrical in cross-section and deviate from a circular shape and are constant in the longitudinal direction of extension.
Figure 25:
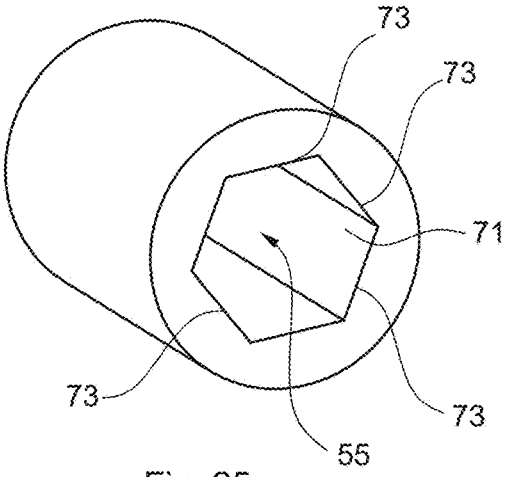
Figure 26:
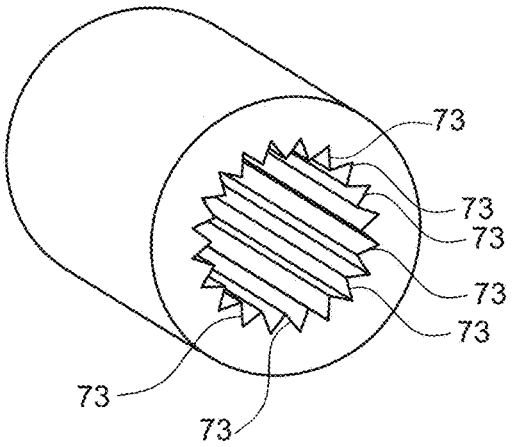
Figure 27:
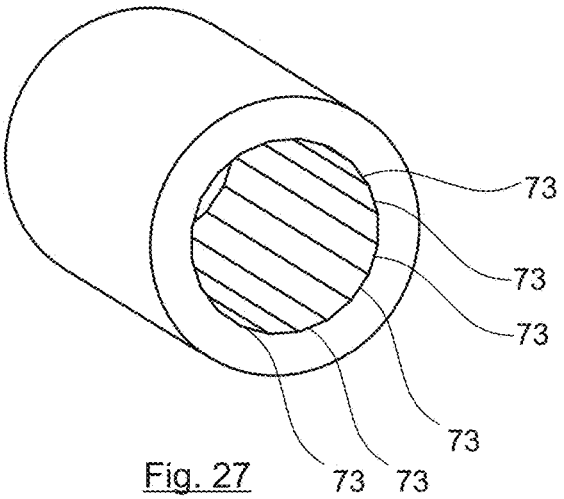

FIGS. 34*a, b* and 35*a, b* show a sectional view of the projectile 1 according to the disclosure analogous to FIG. 4. On the sectional view surface, a hardness distribution according to Vickers is shown, a corresponding color scale with reference values is located between FIGS. 34*a, b* and 35*a, b*. FIGS. 34*a* and 34*b* represent a projectile 1 which is made of a solid intermediate, this solid material can be for example a wire section and is cylindrical, the material is further holeless, therefore it is also called solid intermediate. FIGS. 35*a* and 35*b* represent a projectile 1 made from a tube, the tubular intermediate 3 here preferably consists of a tube section 4 made from the tube, wherein the tube can be either in bar form or coiled and is separated by metal-removing or by means of cutting, crushing or grinding.

FIGS. 34*a* and 35*a* show the hardness distribution of a projectile 1 manufactured starting from hard intermediate material. The projectile 34*a* is made of solid intermediate material, the projectile in FIG. 35*a* is made of a tubular intermediate 3 with the wall thickness a.

FIGS. 34*b* and 35*b* each show the hardness distributions of a projectile made from soft copper. The projectile 34*b* is made of a solid intermediate, the projectile in FIG. 35*b* is made of a tubular intermediate 3 with the wall thickness a.

The illustration according to FIGS. 34*a, b* and 35*a, b* should be understood as showing that the absolute material hardness according to Vickers was determined on the finalized projectile 1. Once with hard copper (FIGS. 34*a* and 35*a*) and once with soft copper (FIGS. 34*b* and 35*b*). The selected copper hardnesses differ measurably from each other; this can be done with non-destructive material testing, for example ultrasound, or with destructive material testing, for example with indenters. Such differences in hardness can be due to different alloys, different raw material production or different post-processing, such as annealing. If we refer only to the relative hardness profile, in other words to the uniform hardness distribution in the bullet, without considering the absolute hardness values in the bullet, there is comparability of the hardness profiles between FIG. 34*a* and FIG. 34*b*. Furthermore, the comparability of the hardness curves, by neglecting the absolute hardness values, between FIGS. 35*a* and 35*b* is also given. Therefore, the differences between the tubular intermediates 3 and the solid intermediates will be discussed in more detail below.

The hardness values of the tip 29 and the hardness values of the bullet front 53 of the projectile 1 are increased compared to the rest of the bullet body 13. Due to the reduced deformation during the pressing process, the projectiles 1 which are made of the tubular intermediate 3 are softer in the region of the guide band 63, as compared to the projectiles which are made of a solid intermediate, also called a wire blank. This softer region has a positive influence on the barrel lifetime of the firearm and results in a longer tool lifetime of the die 7 and the tool 100. A soft intermediate region of the projectile 1 is particularly relevant for long service lifetimes of the tools. The softer the intermediate region of the eventual projectile 1 remains due to the previous operations, the less forming work the tools had to perform during the operations. This results in a longer tool lifetime. Accordingly, a conclusion can be drawn about the tool lifetime from the hardness profile in the tube projectile according to the disclosure.

The region of tip 29 marks the hardest part of all projectiles in FIGS. 34 and 35 due to the high degree of deformation. In the case of hard copper, a Vickers hardness of approx. 230 HV is present in the region of tip 29, irrespective of the intermediate type. The soft copper has a Vickers hardness of approx. 170 HV, irrespective of the intermediate type. The majority of the bullet front 53, indicated by reference 39, experiences a significant hardness increase of about 60-100% over the intermediate hardness. A second hardness increase is evident in the region of the cavity base section 57. In the case of the projectile 1 made from the tubular intermediate 3 (FIG. 35*a, b*), an increase in hardness is evident from the cavity base section 57 through the bullet bottom to the rear constriction 11.

However, if the blank consists of a solid material intermediate (FIG. 34*a, b*), the increase in hardness is apparent in particular at the cavity base section 57. The bullet bottom 17 of the projectile 1 made from the tubular intermediate 3 has an average hardness which corresponds to at least 103%, in particular at least 105%, of that average hardness if the projectile 1 were made from a solid material and holeless intermediate. This increase in hardness has a positive influence with regard to the resistance of the launch shock, resulting in improved ballistics. The averaged hardness in the region of a jacket region of the bullet rear 51 surrounding the cavity 45 corresponds to at most 90%, in particular at most 85% or at most 80%, of that averaged hardness if the projectile 1 were made from a solid material, i.e. solid and holeless intermediate. This has a positive effect on the barrel load of the firearm barrel. The projectile 1 based on the tubular intermediate 3 has at the bullet rear 51, an averaged hardness of at least 140%, in particular at least 150% or at least 160%, which corresponds to that averaged hardness if the projectile were made from a solid intermediate. The average hardness, in particular of the cylindrical region of the guide band 63 of the projectile 1 based on the tubular intermediate 3, is softer over the entire diameter, in particular at least 10%, at least 15% or at least 20%, softer than the average hardness if the projectile 1 were made from a solid and holeless intermediate.

It is particularly advantageous in the case of projectiles 1 made from an intermediate 3 according to the present disclosure that there is only a slight increase in hardness in the region of the guide band 63, so that in the region of the land-groove dimension of the projectile 1 and in the central region of the engagement of the pressed part 80 there is a substantially low hardness according to Vickers, the hardness values being near-surface values. According to the disclosure, it was found that the homogeneous hardness distribution formed in this way has a positive effect on the ballistics and precision of the projectile 1 and, in particular, a positive effect on the tool lifetime of the delicate pressed part 80.

The projectiles 1 made of solid material intermediate 3, shown in FIG. 34, have a hardness, which is homogeneous and largely comparable with the original material, in the region of the bullet rear 51, in particular in the region of the rear chamfer 61, over the entire bullet diameter. In FIG. 35, the projectiles 1 made of tubular intermediate 3 are hard and inhomogeneous, in particular in the region of the rear constriction 11. This inhomogeneity of the hardness profile in the bullet rear 51 has the technical effect of stiffening the bullet bottom 17, which has a positive effect on the internal ballistics during the acceleration process of the projectile 1. Furthermore, the hardening at the rear constriction 11 of the bullet rear creates a kind of predetermined breaking point, which relieves excess hydrodynamic pressure during penetration into the gelatinous mass of the wound ballistics and stabilizes the projectile during penetration.

A subdivision of the hardness levels is shown in FIG. 34*a* and FIG. 35*a*. The reference sign w indicates zones with low hardness, 120 HV. The reference sign m indicates zones with medium hardness, approx. 190 HV. The reference sign h denotes zones of the projectile 1 with increased hardness, approx. 230 HV. In FIG. 35*a*, the surfaces enclosed by w represent the guide band 63 of the projectile 1 and, due to their soft design, can perform the function of reducing the press-through resistance by the firearm barrel. The hard zones on the front wall 41 and the rear constriction 11 define the deformation properties in the projectile according to the disclosure as shown in FIG. 35*a*. The transition region, also called the medium-hard zone m, prevents the segment flags 111 from tearing off in the projectile 1 according to the disclosure, manufactured from a tubular intermediate 3.

The hardness zones of the projectile 1 made of a solid intermediate material have only limited ballistically optimized properties. The medium-hard zone m extends into the guide band 63. The hard zone h extends beyond the kink of the segment flags 111. The soft zone w is located exclusively in the bullet bottom 17.

On the bullet front side, the projectiles 1 made from the tubular intermediate 3 differ from those made from solid material intermediates in that the bullet front 53 has a shorter transition phase from the hard tip 29 to the soft guide band 63. FIG. 35 shows that the hard bullet front 53 begins to soften in the direction of the bullet rear after about ⅔ of the ogive section and approaches the initial hardness of the intermediate. The bullet, made of solid material (FIG. 34), has a uniformly distributed hardness at the bullet front 53; only after the section of the bullet front 53 does the transition phase of the hardness begin, which extends over the entire guide band 63. The technical effect of the short hardness transition phase in the bullet front 53 according to FIG. 35 is that the segment flags 111 can bend over to a maximum without cracks forming in the bent-over segment flags 111. Unstressed or unhardened material can generally be deformed/bent to a greater extent without damage than stressed material.

The features disclosed in the foregoing description, figures, and claims may be significant, both individually and in any combination, for the realization of the disclosure in the various embodiments.

To enable those skilled in the art to better understand the solution of the present disclosure, the technical solution in the embodiments of the present disclosure is described clearly and completely below in conjunction with the drawings in the embodiments of the present disclosure. Obviously, the embodiments described are only some, not all, of the embodiments of the present disclosure. All other embodiments obtained by those skilled in the art on the basis of the embodiments in the present disclosure without any creative effort should fall within the scope of protection of the present disclosure.

It should be noted that the terms "first", "second", etc. in the description, claims and abovementioned drawings of the present disclosure are used to distinguish between similar objects, but not necessarily used to describe a specific order or sequence. It should be understood that data used in this way can be interchanged as appropriate so that the embodiments of the present disclosure described here can be implemented in an order other than those shown or described here. In addition, the terms "comprise" and "have" and any variants thereof are intended to cover non-exclusive inclusion. For example, a process, method, system, product or equipment comprising a series of steps or modules or units is not necessarily limited to those steps or modules or units which are clearly listed, but may comprise other steps or modules or units which are not clearly listed or are intrinsic to such processes, methods, products or equipment.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

REFERENCE LIST

1 Projectile
3 Intermediate
4 Tube section
5 Countersunk intermediate
7 Die
9 Preform
10 Pressed part
11 Rear constriction
13 Bullet body
17 Bullet bottom
19 Countersink
21 Rear cavity
23 Edge
25 Intermediate planar surface
27 central constriction
29 Tip
31 End face
33 Front fold
35 Opening
37 Opposite end face
39 Inner tube surface
41 Front wall
43 Wall slots

45 Cavity
47 Conical tool
49 Launched, deformed bullet
51 Bullet rear
53 Bullet front
55 Tube cavity
57 Cavity base section
59 Rear cavity base section
61 Rear chamfer
63 Guide band
65 Hollow cylinder
67 Hollow cylinder inner surface
71 Wall inner surface
73 Partial segment
75 Tapering cavity section
77 Segment edge
79 Guide part
80 Press part
81 Segment flank
83 Tool shank
85 Press tip/guide tip
87 Outer jacket surface
89 Concave forming section
91 Convex forming section
93 Die-cylinder inner surface
95 Tapering
97 Front side
99 Ejector side die
101 Front side
103 Transition region
105 Plan area
107 Holding section/round section
108 Forming section
100 Tool
111 Segment flag
113 Metal body
117 Rear filler
119 Front filler
L Longitudinal direction
P Pressing direction
a Raw wall thickness
b Rear cavity wall thickness
h hard zone
m middle zone
w soft zone

The invention claimed is:

1. A cold-formed projectile for ammunition, comprising:
a central cavity; and
a bullet jacket surrounding the central cavity, the bullet jacket including an ogive-shaped bullet front and an adjoining bullet rear with a solid rear portion leading to a bullet bottom,
wherein the cold-formed projectile is cold formed from an intermediate with a tube section of constant wall thickness, which constitutes at least 50% of a longitudinal extension of the intermediate, an outer diameter of the intermediate corresponding to a caliber of the projectile,
wherein an inner tube diameter is at most 50% of an outer tube diameter of the tube section, and
wherein an inner cross-section of the tube section is point-symmetrical, deviates from a circular shape, and is constant in a direction of the longitudinal extension.

2. The projectile according to claim 1, wherein:
an averaged hardness at the bullet bottom corresponds to at least 103% of that averaged hardness if the projectile were made from a solid intermediate, and/or
an averaged hardness in a region of a jacket region of the bullet rear surrounding the cavity corresponds to at most 90% of that averaged hardness if the projectile were made from a solid intermediate.

3. The projectile according to claim 2, wherein the hardness values are near-surface values.

4. The projectile according to claim 2, wherein the jacket region of the bullet rear surrounding the cavity comprises a guide band configured to engage in a land-groove-profile of a firearm barrel, the guide band defining a maximum outer diameter of the projectile, wherein an averaged hardness of the guide band over its entire radial depth is softer than that averaged hardness if the projectile were made of a solid intermediate.

5. The projectile according to claim 2, wherein the bullet rear in an axial projection of the cavity has a solidified core region, extending in the longitudinal direction of the projectile up to the bullet bottom, with a higher average hardness than bullet rear regions adjacent to the core region, whose average hardness corresponds to at least 140% of that average hardness if the projectile were made from a solid intermediate.

6. The projectile according to claim 1, wherein the projectile is a deformation bullet, a partial fragmentation bullet, a partial or full jacket bullet, a hard-core bullet, or tracer bullet.

7. The projectile according to claim 1, wherein the projectile has a caliber in a range from 4.6 mm to 20 mm.

8. The projectile according to claim 1, wherein the bullet jacket comprises a single-piece construction.

9. The projectile according to claim 1, wherein the inner tube diameter is constant and at least one-third of the outer tube diameter.

10. The projectile according to claim 1, wherein the inner cross-section of the tube section is triangular, square, pentagonal, hexagonal, or star-shaped.

11. A method of producing a projectile, comprising:
inserting, into a die, an intermediate including a tube section of constant wall thickness, the tube section constituting at least 50% of a longitudinal extension of the intermediate, an outer diameter of the intermediate corresponding to a caliber of the projectile, and an inner tube diameter being at most 50% of an outer tube diameter of the tube section, wherein an inner cross-section of the tube section is point-symmetrical, deviates from a circular shape, and is constant in a direction of the longitudinal extension; and
cold forming the intermediate using a tool such that, at least sectionally, an outer diameter of the intermediate remains constant and determines the projectile caliber, wherein the produced projectile comprises a central cavity and a bullet jacket surrounding the central cavity, the bullet jacket including an ogive-shaped bullet front and an adjoining bullet rear with a solid rear portion leading to a bullet bottom.

12. The method according to claim 11, wherein the cold forming comprises extrusion.

13. The method according to claim 11, wherein the intermediate is a tubular metallic intermediate of copper, aluminum, iron, soft iron, silver, titanium, tungsten, tin, zinc, magnesium, lead, cadmium or alloys thereof.

14. The method according to claim 11, wherein the tool comprises:
a holding section; and
a tapering forming section including:
a tip, an elongated guide part adjoining the tip and configured to guide the tool within the cavity of the tube section, wherein the guide part is at least sectionally curved and concave-shaped or conically-shaped, and a press part adjoining the elongated guide part in a projection-free manner, the press part being at least sectionally curved and concave-shaped or conically-shaped, wherein the press part has a different inclination to a longitudinal axis of the tool.

15. The method according to claim 11, wherein the produced projectile has a caliber in a range from 4.6 mm to 20 mm.

* * * * *